US010254678B2

(12) United States Patent
Matsushita et al.

(10) Patent No.: US 10,254,678 B2
(45) Date of Patent: Apr. 9, 2019

(54) IMAGE FORMING APPARATUS HAVING IMAGE BEARING MEMBER AND COLLECTION DEVICE TO COLLECT MATERIALS ADHERED ON THE IMAGE BEARING MEMBER

(71) Applicant: BROTHER KOGYO KABUSHIKI KAISHA, Nagoya, Aichi (JP)

(72) Inventors: Yuichi Matsushita, Nagoya (JP); Hiroshige Hiramatsu, Inuyama (JP); Chieko Mimura, Nagoya (JP); Kengo Yada, Seki (JP); Hotaka Kakutani, Kiyosu (JP); Shota Iriyama, Toyokawa (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 15/711,393

(22) Filed: Sep. 21, 2017

(65) Prior Publication Data

US 2018/0088486 A1 Mar. 29, 2018

(30) Foreign Application Priority Data

Sep. 29, 2016 (JP) ..... 2016-191789

(51) Int. Cl.
*G03G 21/00* (2006.01)
*G03G 15/08* (2006.01)
(Continued)

(52) U.S. Cl.
CPC ..... *G03G 15/0808* (2013.01); *G03G 15/0275* (2013.01); *G03G 21/0005* (2013.01);
(Continued)

(58) Field of Classification Search
CPC ..... G03G 21/0064; G03G 21/0058; G03G 21/0005; G03G 21/007; G03G 2215/025;
(Continued)

(56) References Cited

U.S. PATENT DOCUMENTS 6,173,135 B1 1/2001 Yuminamochi et al.
2003/0035657 A1* 2/2003 Asano ..... G03G 15/0822 399/53
(Continued)

FOREIGN PATENT DOCUMENTS

JP 2000-029281 A 1/2000
JP 2002-372902 A 12/2002
(Continued)

*Primary Examiner* — Joseph S Wong
(74) *Attorney, Agent, or Firm* — Scully, Scott, Murphy & Presser, PC

(57) ABSTRACT

In an image forming apparatus, the image bearing member has a surface and configured to rotate about an axis. The collection device is in contact with the surface, and configured to collect materials adhered to the surface. The developing roller is configured to provide a charged toner having a first polarity. The processor is configured to perform: executing a print job in a printing period; executing, in a non-printing period, a first process in which the image bearing member is rotated at least one rotation while a holding bias is applied to the collection device, the holding bias having a second polarity opposite to the first polarity; and executing, in a non-printing period after the first process, a second process in which the image bearing member is rotated while an ejection bias is applied to the collection device, the ejection bias having the first polarity.

21 Claims, 7 Drawing Sheets

(51) Int. Cl.

| | |
|---|---|
| ***G03G 15/02*** | (2006.01) |
| ***G03G 21/10*** | (2006.01) |
| ***G03G 21/16*** | (2006.01) |
| *G03G 15/04* | (2006.01) |
| *G03G 15/045* | (2006.01) |
| *G03G 15/00* | (2006.01) |

(52) U.S. Cl.
CPC ..... *G03G 21/007* (2013.01); *G03G 21/0058* (2013.01); *G03G 21/0064* (2013.01); *G03G 21/10* (2013.01); *G03G 21/1647* (2013.01); *G03G 15/045* (2013.01); *G03G 15/04072* (2013.01); *G03G 15/6552* (2013.01); *G03G 2215/00421* (2013.01); *G03G 2215/025* (2013.01); *G03G 2217/005* (2013.01); *G03G 2221/0005* (2013.01); *G03G 2221/0021* (2013.01); *G03G 2221/0026* (2013.01); *G03G 2221/0073* (2013.01); *G03G 2221/0089* (2013.01)

(58) Field of Classification Search
CPC ... G03G 2221/0073; G03G 2221/0005; G03G 2221/0026; G03G 2221/0021; G03G 2221/0089
See application file for complete search history.

(56) References Cited

U.S. PATENT DOCUMENTS

| | | | | |
|---|---|---|---|---|
| 2006/0140665 | A1 | 6/2006 | Hashimoto et al. | |
| 2007/0020005 | A1* | 1/2007 | Shigezaki ..... | G03G 21/0017 399/349 |
| 2008/0317506 | A1 | 12/2008 | Furukawa | |
| 2009/0324279 | A1 | 12/2009 | Miyahara et al. | |
| 2011/0182596 | A1 | 7/2011 | Ishii | |
| 2013/0108289 | A1* | 5/2013 | Tamura ..... | G03G 15/0194 399/43 |
| 2014/0363180 | A1 | 12/2014 | Itani | |
| 2015/0117882 | A1* | 4/2015 | Wakamatsu ..... | G03G 21/0058 399/44 |
| 2015/0301494 | A1 | 10/2015 | Kitabayashi et al. | |

FOREIGN PATENT DOCUMENTS

| | | | |
|---|---|---|---|
| JP | 2006-209107 | A | 8/2006 |
| JP | 2009-003377 | A | 1/2009 |
| JP | 2010-008652 | A | 1/2010 |
| JP | 2011-170320 | A | 9/2011 |
| JP | 2014-238516 | A | 12/2014 |
| JP | 2015-206827 | A | 11/2015 |
| JP | 2015-230472 | A | 12/2015 |

* cited by examiner

IMAGE FORMING APPARATUS HAVING IMAGE BEARING MEMBER AND COLLECTION DEVICE TO COLLECT MATERIALS ADHERED ON THE IMAGE BEARING MEMBER

CROSS REFERENCE TO RELATED APPLICATION

This application claims priority from Japanese Patent Application No. 2016-191789 filed Sep. 29, 2016. The entire content of the priority application is incorporated herein by reference.

TECHNICAL FIELD

The present disclosure relates to an image forming apparatus configured to form an image in an electrographic method, a method for controlling the image forming apparatus, and a program.

BACKGROUND

Conventionally, an image forming apparatus forms an image according to an electrographic method. In such an image forming apparatus, foreign materials, such as paper dusts, are attached on a surface of an image bearing member such as photosensitive member. The image forming apparatus is provided with a cleaning device configured to clean the surface of the image bearing member by collecting the foreign materials attached on the surface of the image bearing member. However, there is a possibility that some foreign materials are not collected by the cleaning device and fixed to the surface of the image bearing member. The fixed materials change an electric resistance and an optical transparency of the surface of the image bearing member, thereby causing reduction of image quality.

A known image forming apparatus having a cleaning device supplies tonner on a surface of a photosensitive member and collects foreign materials on the surface of the photosensitive member together with the toner when printing operation is not performed.

SUMMARY

In order to attain the above and other objects, the disclosure provides an image forming apparatus. The image forming apparatus includes an image bearing member, a collection device, a developing roller, and a processor. The image bearing member has a surface and configured to rotate about an axis. The collection device is in contact with the surface, and configured to collect materials adhered to the surface. The developing roller is configured to provide a charged toner having a first polarity. The processor is configured to perform: executing a print job in a printing period; executing, in a non-printing period, a first process in which the image bearing member is rotated at least one rotation while a holding bias is applied to the collection device, the holding bias having a second polarity opposite to the first polarity; and executing, in a non-printing period after the first process, a second process in which the image bearing member is rotated while an ejection bias is applied to the collection device, the ejection bias having the first polarity.

BRIEF DESCRIPTION OF THE DRAWINGS

The particular features and advantages of the disclosure as well as other objects will become apparent from the following description taken in connection with the accompanying drawings, in which.

DETAILED DESCRIPTION

An image forming apparatus according to an embodiment will be explained while referring to attached drawings. The embodiment explains a printer having an image forming function.

Figure 1:
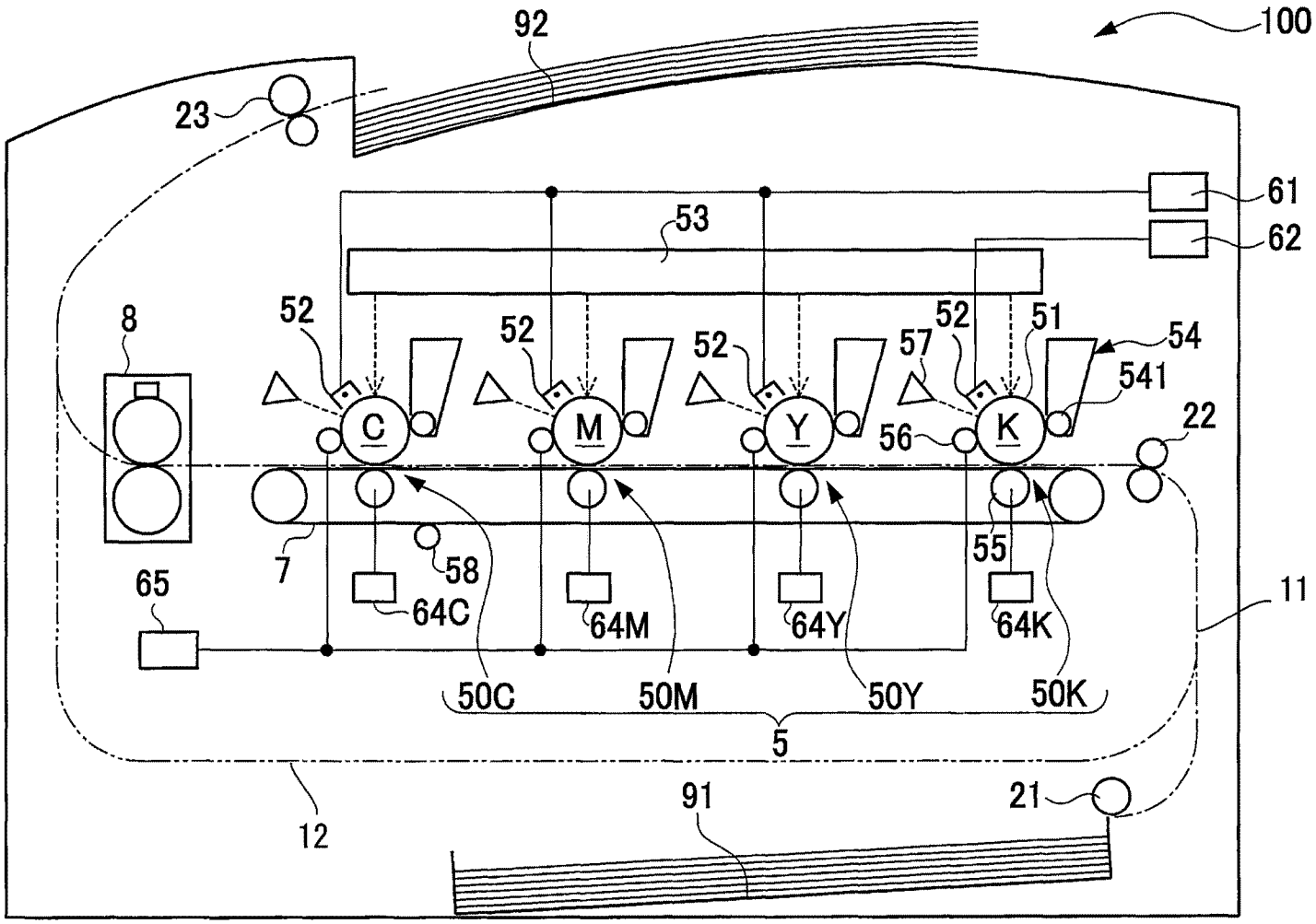
FIG. 1 is a cross section illustrating a printer according to an embodiment.

As shown in FIG. 1 a printer 100 is a color printer configured to form an color image on a sheet as an image transfer member according to the electrographic method. The printer 100 includes a process device 5, a conveyance belt 7, and a fixing device 8. The process device 5 is configured to form toner images and transfer the toner images on a sheet. The conveyance belt 7 is configured to convey the sheet through the process device 5. The fixing device 8 fixes the toner on the sheet. The printer 100 further includes a paper feed tray 91 and a paper discharge tray 92. Sheets, to which toner images are to be transferred, are placed on the paper feed tray 91. The sheets, to which toner images have been transferred, are placed on the paper discharge tray 92.

As shown in a one-dot chain line in FIG. 1, the printer 100 is provided with a conveyance path 11 having a S-shape for conveying a sheet. The printer 100 further includes a feed roller 21, registration rollers 22, discharge rollers 23, in order to convey the sheet along the conveyance path 11. In other words, the printer 100 conveys the sheet, which is initially accommodated in the paper feed tray 91, along the conveyance path 11 and discharges the sheet on the paper discharge tray 92 by using the feed roller 21, the registration rollers 22, the conveyance belt 7, and the discharge rollers 23.

As shown in a two-dot chain line in FIG. 1, the printer 100 is further provided with a reversing conveyance path 12 branched from the conveyance path 11. When the printer 100 performs duplex printing, at first the printer 100 prints an image on a first surface of the sheet. Subsequently, the printer 100 reverses a conveyance direction of the sheet with an image printed on the first surface thereof, at a timing after the sheet passed through the fixing device 8 and before the sheet is discharged from the paper discharge tray 92. Further, the printer 100 conveys the sheet along the reversing conveyance path 12 so that the sheet reaches an upstream position of the process device 5 on the conveyance path 11. Finally, the printer 100 prints an image on a second surface of the sheet opposite to the first surface.

The process device 5 includes structures for forming images of respective colors. Specifically, as shown in FIG. 1, the process device 5 includes process devices 50K, 50Y, 50M, 50C for respective colors of black, yellow, magenta, and cyan arranged at equal intervals in this order in an advancing direction of the conveyance belt 7. The arrangement order of the process devices 50 is not limited to the above. In the embodiment, the printer 100 uses positive-charging and single-component toner to form an image.

The black process device 50K includes a photosensitive member 51 having a drum rotatable about an axis thereof in a rotational direction. The photosensitive member 51 is an example of an image bearing member. The process device 50K further includes a charging device 52, a developing device 54, a transferring device 55, a cleaner 56, a discharge lamp 57, arranged around the photosensitive member 51 in this order in the rotational direction of the photosensitive member 51 (a clockwise direction of FIG. 1). The position of the discharge lamp 57 is not limited to the above position. The discharge lamp 57 may be placed at any position along the surface of the photosensitive member 51 from a transferring position to a charging position in the rotational direction of the photosensitive member 51, provided that the discharge lamp 57 can discharge the surface of the photosensitive member 51. Here, the transferring position indicates a position on the surface of the photosensitive member 51 where the toner image is transferred on the sheet by the transferring device 55 and the conveyance belt 7. The charging position indicates a position on the surface of the photosensitive member 51 where the charging device 52 charges the surface of the photosensitive member 51.

The configurations of the remaining process devices 50C, 50M, 50Y are the same as the process device 50K except the color of toner. The process device 5 further includes an exposure device 53 which is shared by the process devices 50C, 50M, 50Y, and 50K. The printer 100 further includes a belt cleaner 58 in contact with the conveyance belt 7 at a position outside of the conveyance path 11.

The charging device 52 is a scorotron charger having a wire and a grid to charge the surface of the photosensitive member 51 by electric discharge. The surface of the photosensitive member 51 is substantially uniformly charged by the charging device 52.

The exposure device 53 is an exposure device in a laser exposure method. The exposure device 53 exposes the laser light on the surface of the photosensitive member 51 on the basis of the image data. Accordingly, the exposure device 53 exposes the surface of the photosensitive member 51, and an electrostatic latent image based on the print data is formed on the photosensitive member 51. In the embodiment, the exposure device 53 is shared by the process devices 50C, 50M, 50Y, and 50K. However, the plurality of exposure devices may be provided for respective ones of the process devices 50C, 50M, 50Y, and 50K, for example.

The developing device 54 includes a developing roller 541. The developing device 54 accommodates the toner. The developing device 54 charges the toner and supplies the developing roller 541 with the charged toner. In the developing device 54, a prescribed voltage as a developing bias is applied to the developing roller 541 so as to provide electric potential difference between the developing roller 541 and the photosensitive member 51 and to provide the charged toner onto the electrostatic latent image on the photosensitive member 51. Accordingly, the toner image is formed on the photosensitive member 51.

The transferring device 55 is arranged in parallel to the photosensitive member 51 with the conveyance belt 7 interposed therebetween. In the printer 100, when printing operation is performed, a sheet placed in the paper feed tray 91 is picked up on the sheet-to-sheet basis, and is conveyed onto the conveyance belt 7. A transferring current flows in the transferring device 55 so that the transferring device 55 electrically draws the toner image onto the photosensitive member 51 and transfers, from the photosensitive member 51, the toner image onto the sheet conveyed by the conveyance belt 7.

When printing the color image, toner images are formed on the respective photosensitive members 51, and the toner images are transferred on the sheet so as to be overlapped with each other. When printing the monochrome image, only the process device 50K is operated.

After the toner image is transferred on the sheet, the sheet, on which the toner images are transferred, is conveyed to the fixing device 8, and the toner images are thermally fixed to the sheet. The sheet on which the toner image is thermally fixed is discharged to the paper discharge tray 92.

The cleaner 56 is a rotational member in contact with the photosensitive member 51. A cleaning bias or an ejection bias is selectively applied to the cleaner 56. The cleaning bias has a polarity opposite to a polarity of the charged toner. The ejection bias has a polarity the same as the polarity of the charged toner. The cleaning bias is applied to the cleaner 56 when a print job is executed so that the cleaner 56 electrically draws and collects adhesive materials on the surface of the photosensitive member 51 such as residual toner after transferring the toner image. The cleaner 56 is one example of a first collection device and a photosensitive member cleaning device. After the print job is complete, the ejection bias is applied to the cleaner 56, and the collected adhesive materials are electrically ejected on the surface of the photosensitive member 51 due to the electrical potential difference between the photosensitive member 51 and the cleaner 56. The ejected adhesive materials are transferred on the conveyance belt 7 by the transferring device 55, and finally collected in the belt cleaner 58.

The discharge lamp 57 is a discharge device for discharging the surface of the photosensitive member 51. The discharge lamp 57 is for reducing defects such as ghost. When the discharge lamp 57 is switched on, the electrical potential of the surface of the photosensitive member 51 decreases. Accordingly, the charging bias is controlled by switching on or off the discharge lamp 57 in order to maintain a constant electric potential of the surface of the photosensitive member 51.

The printer 100 includes a first charging bias supply device 61 and a second charging bias supply device 62. The first charging bias supply device 61 is shared by the process devices 50C, 50M, and 50Y which are other than the black process device 50K. That is, the first charging bias supply device 61 supplies the process devices 50C, 50M, and 50Y with respective charging currents. In other words, common voltage is applied to the charging devices 52 for three colors of CMY by the first charging bias supply device 61. The charging bias supply device 62 supplies the process device 50K with a charging current. That is, a voltage is applied to the process device 50K by the second charging bias supply device 62.

The printer 100 further includes four current supply devices 64C, 64M, 64Y, and 64K for supplying the respective process devices 50C, 50M, 50Y, and 50K with respective transferring currents. That is, the printer 100 controls the transferring currents for the respective process devices 50.

The printer 100 further includes a cleaning bias supply device 65 which is shared by the cleaners 56 provided in the process devices 50C, 50M, 50Y, and 50K. A common voltage is applied to the cleaners 56 provided in the process devices 50C, 50M, 50Y, and 50K.

Figure 2:
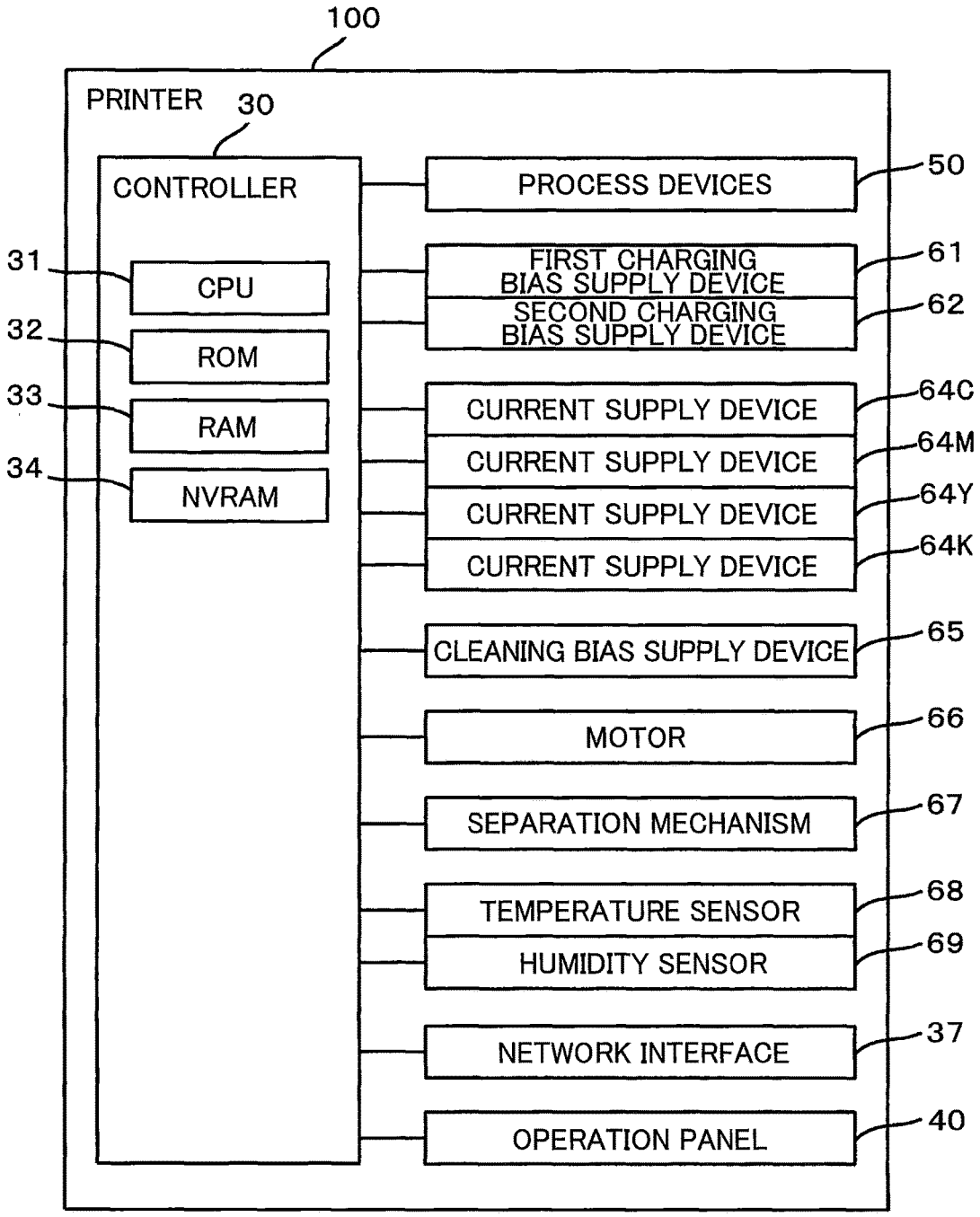
FIG. 2 is a block diagram illustrating electric structures of the printer shown in FIG. 1.

Electrical structures of the printer 100 will be explained. As shown in FIG. 2, the printer 100 includes a controller 30 and process devices 50 (the process device 5) electrically connected with each other. The controller 30 has a CPU 31, a ROM 32, a RAM 33, and an NVRAM (non-volatile RAM) 34.

The ROM 32 stores control programs such as a firmware, setting values, and initial values for controlling the printer 100. The RAM 33 is a working area from which each control program is read, or a storage area for temporarily storing data such as image data.

The CPU 31 controls each component in the printer 100 while storing results of processes in the RAM 33 or the NVRAM 34 according to signals transmitted from the control program read from the ROM 32 or signals transmitted from various devices. The CPU 31 is an example of a processor. Alternatively, the controller 30 may be another example of the processor. The controller 30 is a general term of hardware, such as the CPU 31, used in control of the printer 100, and does not necessarily indicate a single hardware provided in the printer 100.

The first charging bias supply device 61, the second charging bias supply device 62, the four current supply devices 64C, 64M, 64Y, and 64K, and the cleaning bias supply device 65 are electrically connected to the controller 30.

The printer 100 further includes a motor 66, a separation mechanism 67, a temperature sensor 68, a humidity sensor 69, an network interface 37, and an operation panel 40, which are electrically connected to the controller 30. The network interface 37 is used for performing communications via the Internet, for example. The operation panel 40 is a touch screen to receive a user input for example. The motor 66 is configured to rotate the photosensitive members 51 included in the respective process devices 50C, 50M, 50Y, and 50K. The separation mechanism 67 is configured to separate the developing devices 54 included in the respective process devices 50C, 50M, 50Y, and 50K from the corresponding photosensitive members 51.

Driving force from the motor 66 is transferred to the elements including not only the photosensitive members 51 but also the developing rollers 541, the transferring devices 55, the cleaners 56, sheet conveyance members such as the rollers 21, 22, and 23, and others rotational members. The printer 100 includes driving force transferring members such as gears or clutches (not shown) in a transferring path of the driving force generated from the motor 66, for controlling mechanical connections of the elements with the motor 66 and controlling rotational speeds of the rotational elements.

Figure 3:
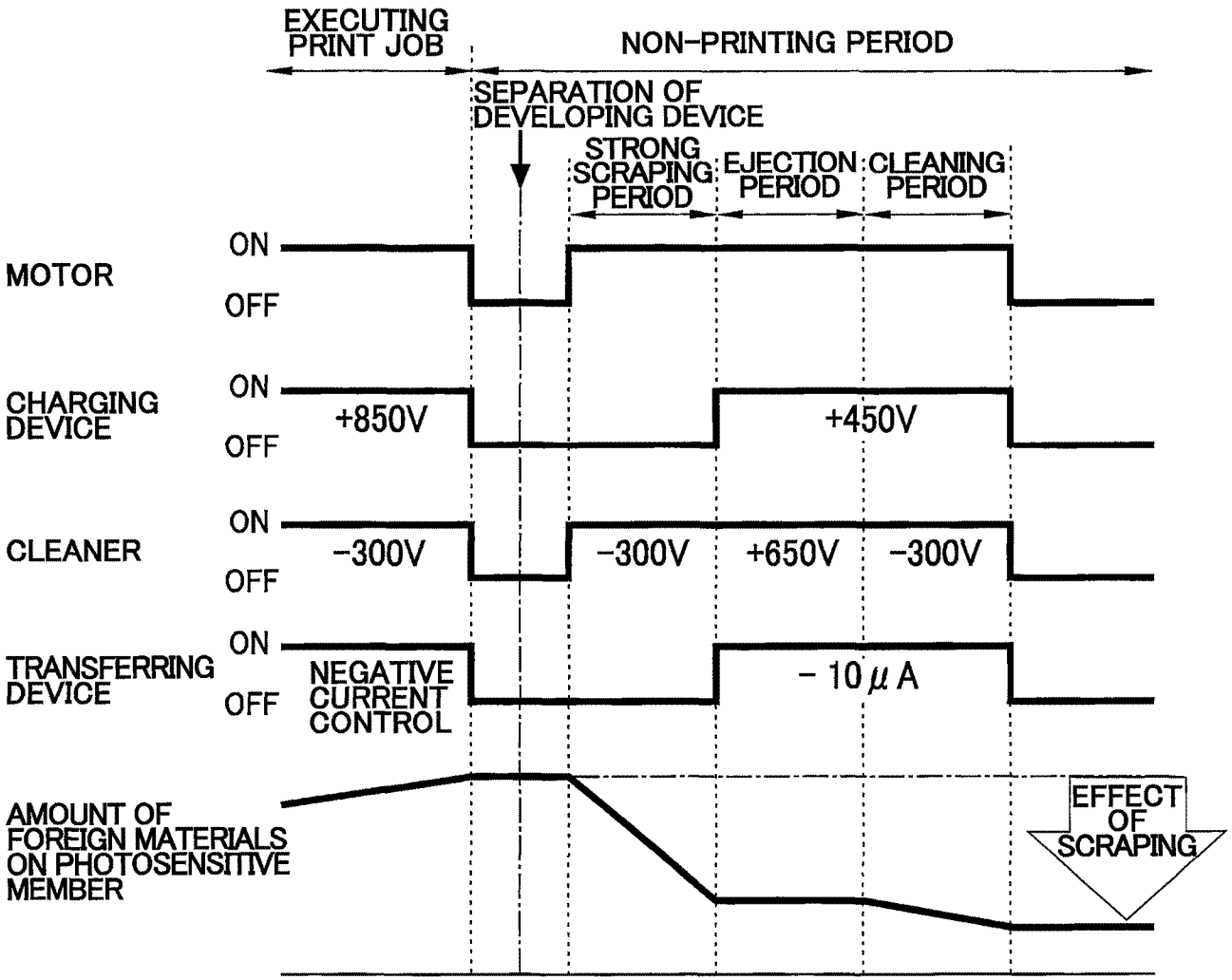
FIG. 3 is a timing chart illustrating control of each device and an amount of foreign materials adhered to a photosensitive member in a case where a strong scraping period is provided in a non-printing period.

Next, a control of devices and an estimated quantity of adhesive materials before or after the print job in the printer 100 will be described while referring to a timing chart shown in FIG. 3. Specifically, FIG. 3 shows control of the motor 66, the charging device 52, the cleaner 56, and the transferring device 55, and shows increase and decrease of the adhesive materials on the photosensitive member 51.

While the printer 100 executes the print job, the CPU 31 allows the motor 66 to be in an ON state so as to rotate each photosensitive member 51. As shown in FIG. 3, the ON state of the motor 66 indicates a state where driving force from the motor 66 is transferred to the photosensitive members 51, and an OFF state of the motor 66 indicates a state where driving force from the motor 66 is not transferred to the photosensitive members 51.

While the printer 100 executes the print job, the CPU 31 allows each charging device 52 to be in an ON state so as to apply to each charging device 52 the charging bias having a polarity the same as that of the charged toner. In the embodiment, the charging bias is +850 V. As shown in FIG. 3, the ON state of the charging device 52 indicates a state where the charging bias or a weak charging bias (described later) is applied to the charging device 52 by corresponding one of the first charging bias supply device 61 and the second charging bias supply device 62. An OFF state of the charging device 52 indicates a state where no bias is applied to the charging device 52.

While the printer 100 executes the print job, the CPU 31 allows each cleaner 56 to be in an ON state so as to apply to each cleaner 56 the cleaning bias having polarity opposite to that of the charged toner. In the embodiment, the cleaning bias is set to −300 V. While the printer 100 executes the print job, the CPU 31 applies to the cleaners 56 the cleaning bias so that the residual toner, which has remained on each photosensitive members 51 after the transferring operation, is moved and adhered to the cleaner 56. As shown in FIG. 3, the ON state of the cleaner 56 indicates that the cleaning bias, the ejection, or a holding bias (described lager) is applied to the cleaner 56 by the cleaning bias supply device 65. An OFF state of the cleaner 56 indicates that no bias is applied to the cleaner 56.

During execution of the print job (or the printing period), the CPU 31 allows each transferring device 55 to be in an ON state so as to supply each transferring devices 55 while the transferring current has a polarity opposite to that of the charged toner. An amount of the transferring current depends on the environmental condition such as temperature and humidity, and a type of the recording sheet. As shown in FIG. 3, the ON state of the transferring device 55 indicates a state where the transferring current is supplied to the transferring device 55 by the corresponding one of the current supply devices 64C, 64M, 64Y, and 64K. An OFF state of the transferring device 55 indicates a state where the transferring current is not supplied to the transferring device 55.

While the printer 100 executes the print job, the sheet passes through each transferring device 55, and foreign materials such as paper dusts adheres to the surface of each photosensitive member 51. Accordingly, while the printer 100 executes the print job, an amounts of the paper dusts adhered to the surface of the photosensitive member 51 gradually increases.

After the printer 100 completes the print job, the CPU 31 switches off all of the motor 66, the charging device 52, the cleaner 56, and the transferring device 55 so as to shift to a non-printing period during which no toner image is formed on the photosensitive member 51.

When the printer 100 shifts to the non-printing period, the CPU 31 inputs a separation instruction to each separation mechanism 67 so that each developing device 54 separates from the corresponding photosensitive member 51. Accordingly, supply of the toner from the developing device 54 to the photosensitive member 51 is restricted during the non-printing period. In other words, consumption of the toner in the developing device 54 is restricted during the non-printing period.

In the example shown in FIG. 3, the non-printing period includes a strong scraping period, an ejection period, and a cleaning period elapsing in this order. After completing the separation operation of the developing device 54, the printer 100 shifts to the strong scraping period. During the strong scraping period, the CPU 31 switches on the motor 66 to rotate each photosensitive member 51. The CPU 31 applies to the cleaner 56 the holding bias having a polarity opposite to that of the charged toner in order to restrict ejection of the toner from the cleaner 56. That is, the cleaner 56 is in the ON state. In the embodiment, the holding bias is set to −300 V. In the strong scraping period, both of the charging device 52 and the transferring device 55 are maintained to the OFF state. In the embodiment, the value of the holding bias is equal to the value of the cleaning bias in order to simplify the structure of the cleaning bias supply device 65. The value of the holding bias may be different from the value of the cleaning bias provided that the cleaner can hold the toner by the holding bias. For example, the holding bias may be smaller than the cleaning bias.

During the strong scraping period, because the holding bias is applied to each cleaner 56, the toner, which has been adhered to each cleaner 56 during the print job, is still held. In this state, the toner held by the cleaner 56 functions as abrasive compound when the photosensitive member 51 rotates. Accordingly, foreign materials such as paper dusts adhered to the surface of each photosensitive member 51 can be scrapped. An amount of paper dusts adhered to the surface of the photosensitive member 51 gradually degreases in the strong scraping period. The CPU 31 performs the strong scraping period until the photosensitive member 51 rotates at least one rotation (at least 360 degrees). In the embodiment, a length of the strong scraping period is varied, and initially set to one seconds.

The CPU 31 sets the rotational speed of each cleaner 56 during the strong scraping period faster than the rotational speed of the cleaner 56 during the print job. Due to the increased rotational speed of the cleaner 56, the difference of the peripheral speed between the cleaner 56 and the photosensitive member 51 during the strong scraping period becomes larger than that when the print job is executed. This increased difference makes the scraping more effective.

After the strong scraping period, the printer 100 shifts to the ejection period. During the ejection period, the CPU 31 maintains the ON state of the motor 66 in order to continue the rotation of each photosensitive member 51. The CPU 31 applies to each cleaner 56 the ejection bias having the polarity the same as that of the charged toner so that the cleaner 56 ejects the toner. The CPU 31 switches on the charging device 52. Accordingly, the cleaner 56 keeps the ON state while the bias applied to the cleaner 56 is changed. In the embodiment, the ejection bias is set to +650 V.

The ejection period is within the non-printing period during which the image is not formed. Accordingly, it is not required that the electrical potential of the surface of the photosensitive member 51 during the ejection period is the same as when the print job is executed. Thus, a weak charging bias is applied to each charging device 52. Here, an absolute value of the weak charging bias is smaller than that of the charging bias. In the embodiment, the weak charging bias is set to +450 V.

During the ejection period, the CPU 31 switches on each transferring device 55 so that the toner ejected from the cleaner 56 is transferred to the conveyance belt 7 and collected in the belt cleaner 58. That is, the adhesive members, which has been ejected from the belt cleaner 58 onto each photosensitive member 51, are collected by the transferring device 55. The transferring device 55 is an example of a second collection device. Because the ejection period is within the non-printing period during which the image is not formed, it is not required that the transferring current is controlled with high accuracy. In the embodiment, the transferring current is a fixed value of −10 μA during the ejection period. The transferring current being applied to the transferring device 55 during the ejection period is an example of a collecting current.

After the ejection period, the printer 100 shifts to the cleaning period while maintaining the on states of the motor 66, each charging device 52, each cleaner 56, and each transferring device 55. Note that in the cleaning period, the bias applied to each cleaner 56 is changed from the ejection bias to the cleaning bias. Accordingly, the residual toner on the surface of each photosensitive member 51 is adhered to the corresponding cleaner 56 again, thereby cleaning the surface of each photosensitive member 51 so as to prepare for starting a next print job.

During the cleaning period, each photosensitive member 51 is scraped while the toner adsorbed by the corresponding cleaner 56 functions as abrasive compound. Similarly to the strong scraping period, foreign materials sticking to the surface of each photosensitive member 51 is scraped. That is, the scraping of the photosensitive member 51 is not limited to the strong scraping period. The cleaning period is provided after the ejection period during which the toner is ejected from the cleaner 56 and collected in the transferring device 55. Thus, an amount of tonner held by the cleaner 56 in the cleaning period is smaller than that when the print job is completed. The effect of scraping in the cleaning period is smaller than that in the strong scraping period.

The amount of foreign materials adhered to the surface of the photosensitive member 51 is reduced by providing the strong scraping period, the ejection period, and the cleaning period after the print job is completed and before the next print job starts. Further, because of these periods are provided, the non-printing period is lengthened, and the next print job may be delayed. In the embodiment, the strong scraping period is provided when it is estimated that the amount of adhesive foreign materials on the surface of the photosensitive member 51 is large, that is, when the foreign materials have significant impact on the image quality.

Figure 4:
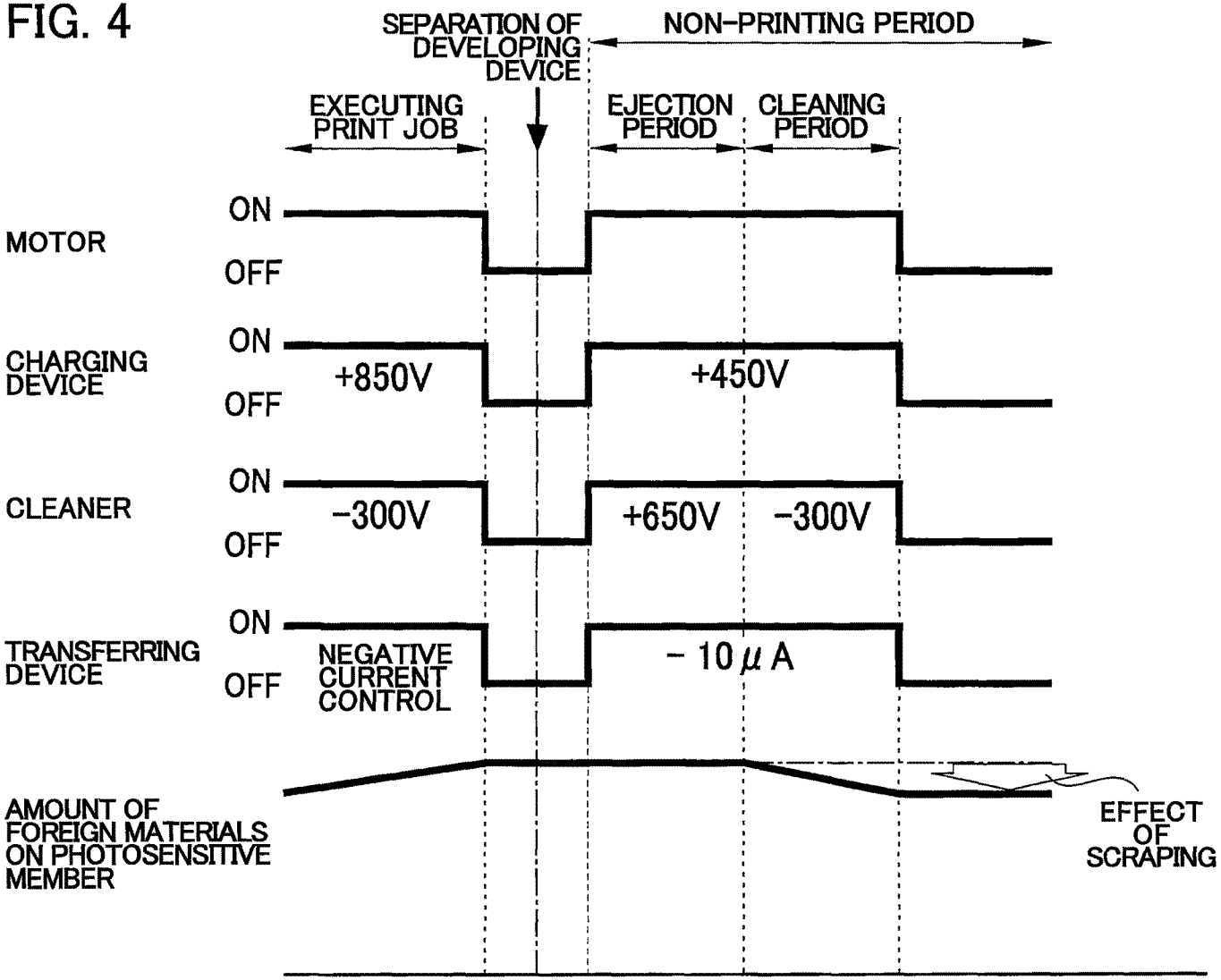
FIG. 4 is a timing chart illustrating control of each device and an amount of foreign materials adhered to the photosensitive member in a case where the strong scraping period is not provided in the non-printing period.

FIG. 4 shows change in control of each device and change in the amount of adhesive foreign materials before and after the execution of the print job when the strong scraping period is not provided in the non-printing period. That is, in the example shown in FIG. 4, the non-printing period includes the ejection period and the cleaning period, but does not include the strong scraping period. In this case, the printer 100 shifts to the ejection period after the developing device 54 separates from the photosensitive member 51 without executing the strong scraping period. In this case, though the considerable number of foreign materials are scraped from the photosensitive member 51 in the cleaning period, the effect of scraping in the non-printing period without the strong scraping period is less than that in the non-printing period having the strong scraping period. On the other hand, the strong scraping period is not provided in the non-printing period shown in FIG. 4, the printer 100 can quickly start the next print job.

Each length of the strong scraping period, the ejection period, and the cleaning period may be varied or fixed. For example, when giving the priority to the removal of the foreign materials on the surface of the photosensitive member 51, the strong scraping period may be extended. Alternatively, when giving the priority to the quick start of the next print job, all or part of the strong scraping period, the ejection period, and the cleaning period may be shortened.

Figure 5:
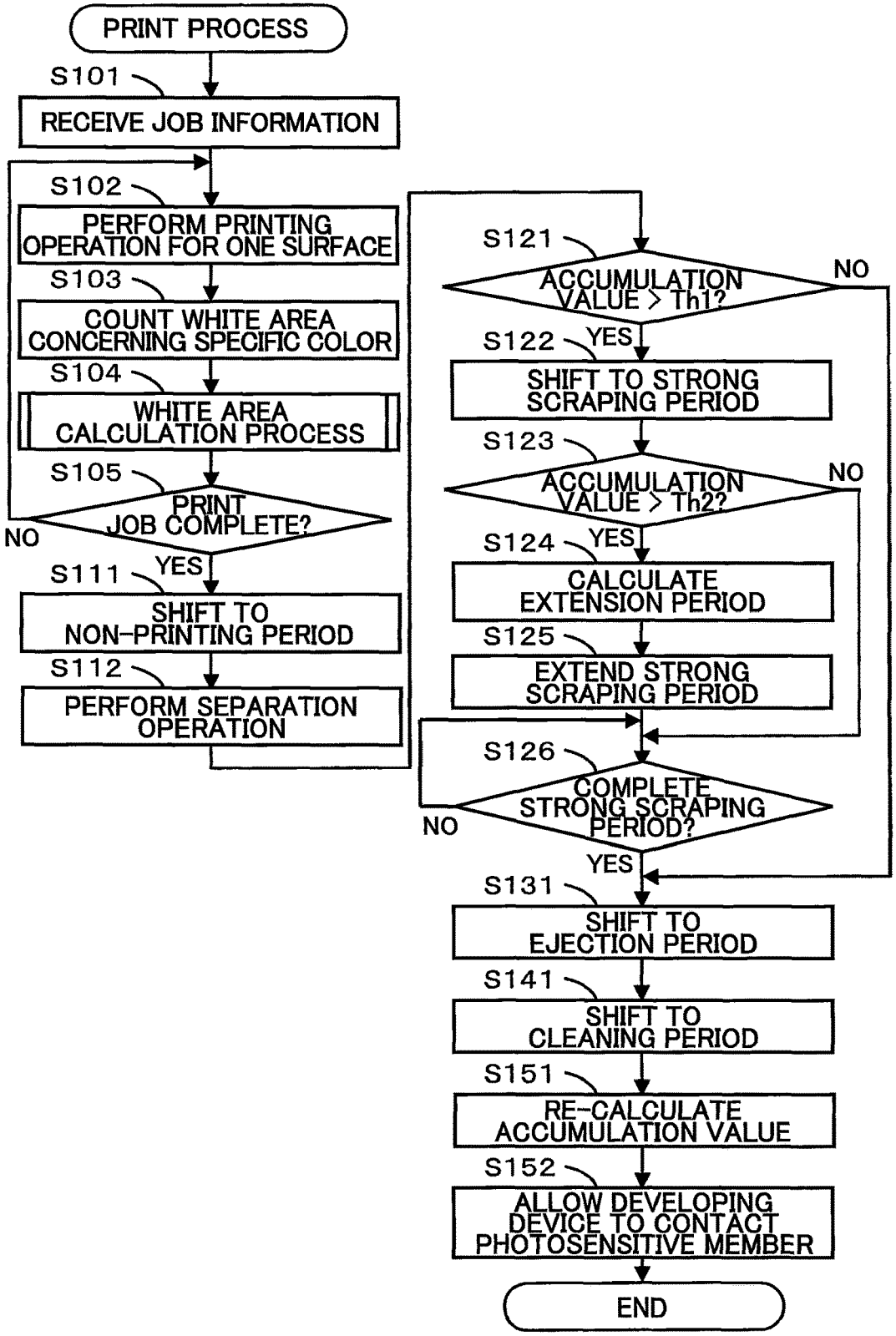
FIG. 5 is a flowchart illustrating a print process according to the embodiment.

A print process including an operation of the printer 100 in the strong scraping period will be described while referring to a flowchart shown in FIG. 5. The print process is triggered by the reception of an instruction of the print job via the network interface 37 or the operation panel 40.

In the print process, in S101 the CPU 31 receives job information for the print job. The job information includes information for a device of a transmission source of the instruction of the print job, information for color settings, information for a paper feed tray and a paper discharge tray, information for a type of sheets, information for a size of sheets, information for necessity or unnecessity of duplex print, for example.

Subsequent to S101, in S102 the CPU 31 receives image data of the print job and performs the printing operation for one surface of the sheet. That is, the CPU 31 rotates the photosensitive member 51 by the driving force from the motor 66, controls the first charging bias supply device 61 and the second charging bias supply device 62 to apply the charging bias to the corresponding charging devices 52, and controls the current supply devices 64C, 64M, 64Y, and 64K to supply the respective transferring currents to the corresponding transferring devices 55. The CPU 31 controls the process device 5 to form the image and controls the conveying devices such as the feed roller 21 to convey the sheet.

While performing the printing operation, in S103 the CPU 31 counts (calculates) a white area concerning a specific color. The specific color is one of colors of toner, that is, one of the cyan, magenta, yellow, and black. The white area is an area of white region (or blank region) in which the toner image of the specific color is not formed. The white area of specific color is calculated by subtracting an area of the printed image concerning the specific color from an area of the sheet. In other words, the white area concerning the specific solid color is total number of dots (or an area corresponding to the total number of dots) corresponding to a region on the sheet at which toner having the specific color is not put. The specific color is a color corresponding to the process device 50 on which a maximum amount of foreign materials are estimated to be adhered among the process devices 50. Most of the foreign materials adhered to the photosensitive member 51 are paper dusts. The paper dusts are generated by fluffing the surface of the sheet (or erecting fibers in the sheet) when the toner image is transferred to the sheet. The amount of the generated paper dusts is tends to be great at a position where the transferring process is firstly performed. In the printer 100, the black process device 50K is firstly performs the transferring process among the process devices 50C, 50M, 50Y, and 50K. Accordingly, the specific color is black, the is the color of the process device 50K in the embodiment. When the monochrome printing is performed, the specific color is also black.

The printer 100 may have a structure where the process device 50Y is located at upstream end in the conveying direction among the process devices 50, and the process device 50Y firstly performs the transferring process to the sheet. In this case, the specific color may not be set to yellow of the process device 50Y, but may set to a color of the process device 50, which performs a transferring process next to the process device 50Y. That is, an estimated amount of adhesive foreign materials is calculated for a color other than yellow. This is because it is not easily determined whether the yellow image is good or bad, and thus the quality of the yellow image less impacts on the total quality of the image.

Figure 6:
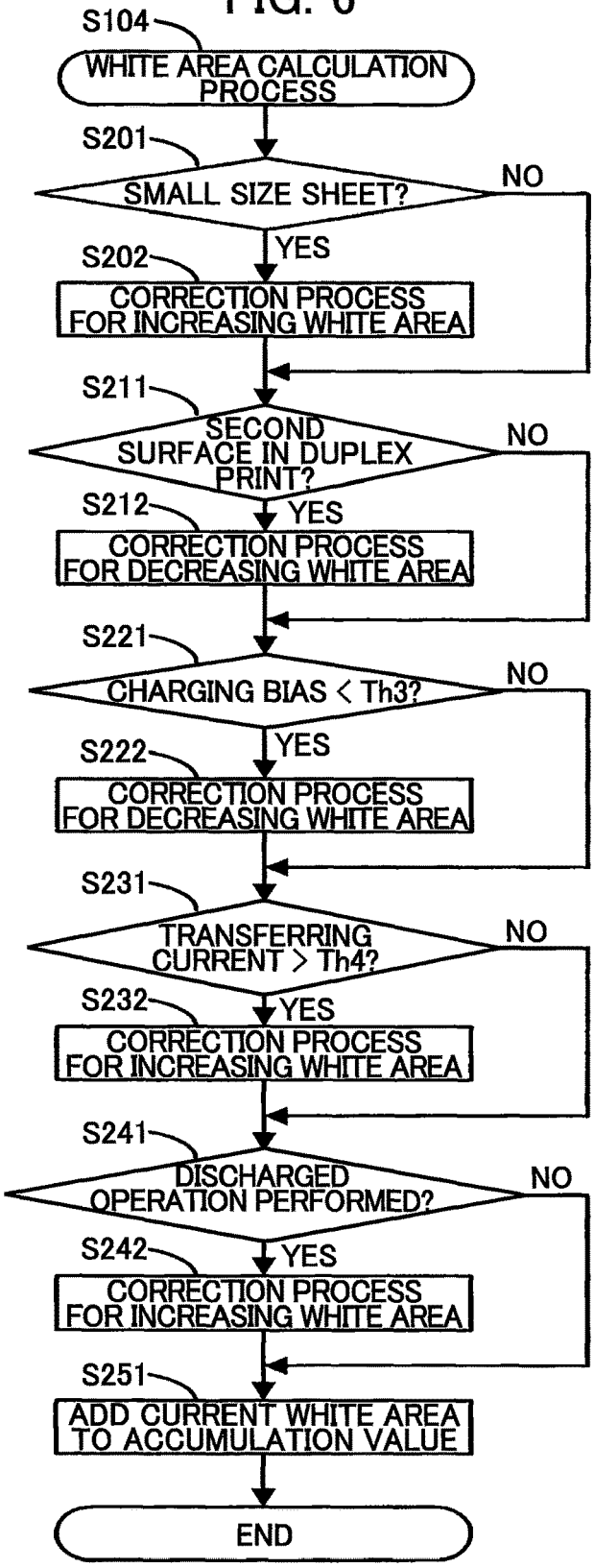
FIG. 6 is a flowchart illustrating a white area calculation process according to the embodiment.

After S103 is performed, in S104 the CPU 31 executes a white area calculation process for calculating an accumulation value of the white areas on the basis of the count value obtained in S103. S103 is an example of a calculation process. FIG. 6 shows a procedure of the white area calculation process S104. In the white area calculation process, the CPU 31 uses the count value obtained in S103 as an initial value of the white area for the current page.

In white area calculation process, in S201 the CPU 31 determines whether the printing operation of the current page is performed on a small size sheet. In the embodiment, the small size sheet is a sheet having an area smaller than an area of an A4 size sheet. When the small size sheet is printed, difference in an amount of foreign materials on the photosensitive member 51 is tend to be larger between a sheet passing region and a non-passing region. Here, the sheet passing region is a region on the photosensitive member 51 through which the current sheet is passed. The non-passing region is a region on the photosensitive member 51 outside of the sheet passing region. When the sheet larger than the small size sheet is printed subsequent to the small size sheet, influence of the adhesive materials on the image of this larger sheet will be noticeable. When the small size sheet is printed (S201: YES), in S202 the CPU 31 performs a correction process on the current white area of the current page so that the corrected white area becomes larger than the current white area in order to increase occurrence of the scraping period. In the correction process of S202 according to the embodiment, the CPU 31 multiplies the current white area by a correction coefficient 1.2 to obtain the corrected white area. The corrected white are obtained in S202 is used as the current white are in the subsequent steps.

After execution of S202, or after determining that the printed sheet is not the small size (S201: NO), in S211 the CPU 31 determines whether the performed printing operation of the current page is for a second surface in the duplex printing. In the duplex printing, the two printing operations are performed for one sheet. That is, a first image is printed on a first surface of the sheet in a firstly performed printing operation, and a second image is printed on a second surface of the sheet in a secondly performed printing operation. The paper dusts generated in the printing operation for the second surface is less than the paper dusts generated in the printing operation for the first surface. When the performed printing operation is for the second surface (S211: YES), in S212 the CPU 31 performs a correction process on the current white area of the current page so that the corrected white area becomes smaller than the current white area in order to reduce occurrence of the scraping period. In the correction process of S212 according to the embodiment, the CPU 31 multiplies the current white area by a correction coefficient 0.7 to obtain the corrected white area. The corrected white are obtained in S212 is used as the current white are in the subsequent steps.

After execution of S212, or after determining that the performed printing operation is not for the second surface in the duplex printing, in S221 the CPU 31 determines whether an absolute value of the charging bias is smaller than a third threshold value Th3 during the printing operation of the current page. When the absolute value of the charging bias is small, an absolute value of the electric potential of the surface of the photosensitive member 51 is small. In this case, the foreign materials is less likely to adhere to the surface of the photosensitive member 51. Accordingly, when the absolute value of the charging bias is smaller than the third threshold value Th3 (S221: YES), in S222 the CPU 31 performs a correction process on the current white area of the current page so that the corrected white area becomes smaller than the current white area in order to reduce occurrence of the scraping period. In the correction process of S222 according to the embodiment, the CPU 31 multiplies the current white area by a correction coefficient 0.8 to obtain the corrected white area. For example, the charging bias is changed in association with a change in a printing speed. The printing speed is changed depending on the types of the sheets, or execution or non-execution of a silent mode, for example. The corrected white area obtained in S222 is used as the current white are in the subsequent steps.

After execution of S222, or after determining that the absolute value of the charging bias is not smaller than the third threshold value Th3 (S221: NO), in S231 the CPU 31 determines whether an absolute value of the transferring current is greater than a fourth threshold value Th4 during the printing operation of the current page. When the absolute value of the transferring current is large, the sheet is easily fluffed (or, fibers in the sheet are easily erected), and foreign materials are easily adhered to the surface of the photosensitive member 51. Accordingly, when the transferring current is greater than the fourth threshold value Th4 (S231: YES), in S232 the CPU 31 performs a correction process on the current white area of the current page so that the corrected white area becomes larger than the current white area in order to increase occurrence of the scraping period. In the correction process of S232 according to the embodiment, the CPU 31 multiplies the current white area by a correction coefficient 1.2 to obtain the corrected white area. Here, the transferring current is changed depending on the types of sheets, a printing speed, execution or non-execution of the duplex printing, and an environmental condition such as temperature and humidity. The corrected white are obtained in S232 is used as the current white are in the subsequent steps.

After execution of S232 or after determining that the transferring current is not greater than the fourth threshold value Th4 (S231: NO), in S241 the CPU 31 determines whether the discharge lamp 57 is switched on during the printing operation of the current page. When the surface of the photosensitive member 51 is discharged, a potential difference between the surface of the photosensitive member 51 and the charging device 52 becomes large, and foreign materials are easily adhered to the photosensitive member 51. When the discharge lamp 57 is switched on (S241: YES), in S242 the CPU 31 performs a correction process on the current white area of the current page so that the corrected white area becomes larger than the current white area in order to increase occurrence of the scraping period. In the correction process of S242 according to the embodiment, the CPU 31 multiplies the current white area by a correction coefficient 1.5 to obtain the corrected white area. Here, the discharge lamp 57 is switched on in a low temperature environment in order to prevent deterioration of the image quality. The corrected white are obtained in S242 is used as the current white are in the subsequent steps.

After execution of S242 or after determining that the discharge lamp 57 is not switched on (S241: NO), in S251 the CPU 31 reads an accumulation value of the white areas and add the current white area of the current page to the read accumulation value, to obtain an updated accumulation value of the white areas. Here, the accumulation value of the white areas is stored in the RAM 33 or the NVRAM 34, and maintained between the print jobs. The stored accumulation value in the RAM 33 or the NVRAM 34 is updated to the updated accumulation value. That is, the updated accumulation value obtained in S251 is used as the current accumulation value in the subsequent steps. After execution of S251 the CPU 31 ends the white area calculation process.

After execution of the white area calculation process of S104, in S105 (FIG. 5) the CPU 31 determines whether the print job is complete. When the print job is not complete (S105: NO), the CPU 31 returns to S102 for performing the printing operation for the next page. That is, the printing for the current print job is continued. While continuing the printing of the current print job, in S103 the CPU 31 counts the white area of the specific color each time the printing operation for one page is performed, and in S104 the CPU 31 updates the accumulation value of the white areas. By repeating the processes S102, all the pages designated by the print job are printed and the print job is complete. That is, repeatedly executing the processes S102 indicates execution of the print job and a period from firstly performed S102 and to a timing when YES determination are made in S105 is a printing period.

When the print job is complete (S105: YES), in S111 the CPU 31 shifts to the non-printing period. Specifically, the CPU 31 controls each photosensitive member 51, each charging device 52, each cleaner 56, and each transferring device 55 to shift to the respective OFF states. After execution of S111, in S112 the CPU 31 inputs the separation instruction to the separation mechanism 67 so as to control each developing device 54 to separate from the corresponding photosensitive member 51.

After execution of S112, in S121 the CPU 31 determines whether the accumulation value of the white areas of the specific color is larger than a first threshold value Th1. The process of S121 is an example of a first determination process. In the embodiment, the first threshold value Th1 is set to 2,400,000 $mm^2$ which corresponds to an area worth of 40 white pages.

When the accumulation value of the white areas of the specific color is larger than the first threshold value Th1 (S121: YES), in S122 the CPU 31 shifts to the strong scraping period. Specifically, the CPU 31 controls each photosensitive member 51 to rotate by driving force from the motor 66, and controls the cleaning bias supply device 65 to apply the holding bias to each cleaner 56. Further, the CPU 31 controls the rotational speed of each cleaner 56 to be faster than when performing the print job. S122 is an example of a scraping process.

After execution of S122, in S123 the CPU 31 determines whether the accumulation value of the white areas of the specific color is larger than a second threshold value Th2. Here, the second threshold value Th2 is larger than the first threshold value Th1. S123 is an example of a second determination process. In the embodiment, the second threshold value Th2 is set to 3,600,000 $mm^2$ which corresponds to an area worth of 60 white pages.

When the accumulation value of the white areas of the specific color is larger than the second threshold value Th2 (S123: YES), in S124 the CPU 31 calculates an extension period by which the strong scraping period is extended. In S125 the CPU 31 extends the strong scraping period by the extension period. When the amount of foreign material is large, it is likely that foreign materials are not removed sufficiently in the normal strong scraping period. Thus, the CPU 31 extends the strong scraping period so as to remove the foreign materials sufficiently.

Figure 7:
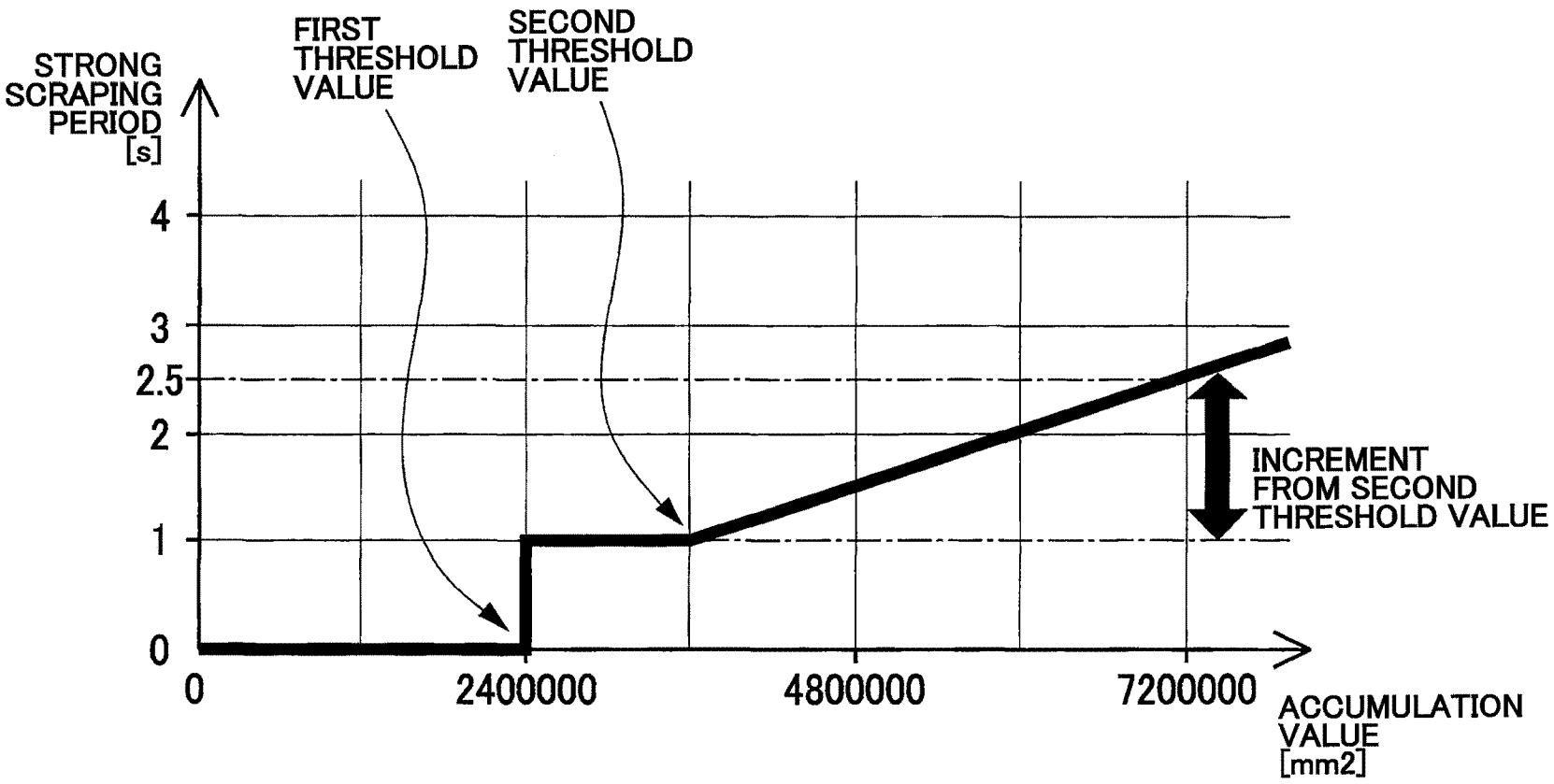
FIG. 7 is a graph illustrating a relation between an white area and a length of the strong scraping period.

FIG. 7 shows a relation between the accumulation value of the white areas and a length of the strong scraping period in the printer 100. The printer 100 sets the strong scraping period to 0 seconds when the accumulation value is in a range from 0 $mm^2$ to 2,400,000 $mm^2$. That is, the strong scraping period is not set in the range of the accumulation value from 0 $mm^2$ to 2,400,000 $mm^2$. The printer 100 sets the strong scraping period to 1 seconds when the accumulation value is in a range from 2,400,001 $mm^2$ to 3,600,000 $mm^2$. That is, the strong scraping period with fixed length is set in the range of the accumulation value from 2,400,001 $mm^2$ to 3,600,000 $mm^2$. The printer 100 sets the strong scraping period to a variable time period when the accumulation value is larger than 3,600,001 $mm^2$. Here, the variable strong time period is a sum of the fixed period of 1 seconds and a variable extension time period which is proportional to an increment of the accumulation value from the second threshold value Th2.

After execution of S125, or after determining that the accumulation of the white areas of the specific color is not larger than the second threshold value Th2 (S123: NO), in S126 the CPU 31 determines whether the strong scraping period ends. When the strong scraping period is not end (S126: NO), the CPU 31 waits the end of the strong scraping period.

When the strong scraping period is end (S126: YES), in S131 the CPU 31 shifts to the ejection period. Specifically, the CPU 31 controls the first charging bias supply device 61 and the second charging bias supply device 62 to apply the weak charging bias to the corresponding charging devices 52, controls the cleaning bias supply device 65 to apply the ejection bias to each cleaner 56, and controls the current supply devices 64C, 64M, 64Y, and 64K to flow the transferring currents to the corresponding transferring devices 55. The CPU 31 sets the belt cleaner 58 to be applied by a prescribed bias for collecting foreign materials. Further, the CPU 31 controls the rotational speed of each cleaner 56 to be equal to that when the print job is executed. S131 is an example of a collection process.

After the ejection period is end, in S141 the CPU 31 shifts to the cleaning period. That is, the CPU 31 controls the cleaning bias supply device 65 to apply the cleaning bias to each cleaner 56.

When the accumulation value of the white areas of the specific color is not larger than the first threshold value Th1 (S121: NO), the CPU 31 skips the strong scraping period and goes to S131 to shift to the ejection period. Subsequently, in S141 the CPU 31 shifts to the cleaning period. In a conceivable case where the strong scraping period is performed each time the print job is complete, the start of the next print job is delayed. Further, since the photosensitive member 51 is frequently scraped, life of the photosensitive member 51 becomes short. On the other hand, when there are few foreign materials, such few foreign materials does not impact on the image quality. According to the embodiment, the strong scraping period is provided when the condition that an estimated amount of foreign materials are large is satisfied, thereby preventing deterioration of the image quality, delay of the start of print, and shortening the life of the photosensitive member 51.

After execution of S141, in S151 the CPU 31 re-calculates (or resets) the accumulation value of the white areas. Specifically, the re-calculation method for calculating the accumulation value is varied according to whether the strong scraping period is provided or not. When the strong scraping period is provided, the CPU 31 subtracts a correction value from the current accumulation value of the white areas to obtain a re-calculated accumulation value of the white areas. Here, the correction value is proportional to a length of the strong scraping period. For example, when the accumulation value of the white areas is 7,200,000 $mm^2$, the strong scraping period is 2.5 seconds as shown in FIG. 7. In the re-calculation according to the embodiment, one second in the strong scraping period is converted to an area of 2,400,000 $mm^2$ for cancelling the accumulation value. So, in this case, the areas for cancelling the accumulation value (that is, the correction value) is calculated as follows, $2.5 \times 2{,}400{,}000\ mm^2 = 6{,}000{,}000\ mm^2$. Accordingly, the new (re-calculated) accumulation value of the white areas is calculated as follows, $7{,}200{,}000\ mm^2 - 2{,}400{,}000\ mm^2 = 1{,}200{,}000\ mm^2$. The white areas of 1,200,000 $mm^2$ will be stored in the RAM 33 or the NVRAM 34 as an accumulation value of the white areas so as to be used in a non-printing period after completion of a next print job.

On the other hand, when the strong scraping period is not provided, that is, when the scraping is performed only in the cleaning period, the CPU 31 sets the accumulation value of the white areas to 0. For example, the accumulation value of the white area is 1,200,000 $mm^2$, the strong scraping period is not provided in the embodiment. In this case, the CPU 31 sets the accumulation value of the white areas to 0, for example.

The method for re-calculating the accumulation value of the white areas is not limited to the above described method. For example, when the strong scraping period is provided, the CPU 31 may set the accumulation value of the white areas to 0 irrespective of the length of the strong scraping period. When the strong scraping period is not provided, the CPU 31 may not change the accumulation value of the white areas.

After execution of S151, in S152 the CPU 31 allows the developing device 54 to be in contact with the photosensitive member 51. The printer 100 may have a structure in which the developing device 54 can supply the photosensitive member 51 with the toner while the developing device 54 is at a prescribed position where the developing device 54 is separated from the photosensitive member 51. In this case, in S152 the CPU 31 may locate the developing device 54 to the prescribed position where the developing device 54 can supply the photosensitive member 51 with the toner. After execution of S152, the CPU 31 ends the print process.

According to the printer 100, the strong scraping period in the non-printing period is provided prior to the ejection period. In the strong scraping period, foreign materials adhered to the surface of the photosensitive member 51 can be removed by scraping the surface of the photosensitive member 51 using the toner retained in the cleaner 56. In the ejection period after the scraping process, the scraped foreign materials are transferred to the conveyance belt 7 by the transferring device 55 together with the toner which was retained in the cleaner 56, and collected to the belt cleaner 58. Accordingly, the foreign materials on the surface of the photosensitive member 51 can be removed more certainly than when the strong scraping period is not provided prior to the ejection period, thereby preventing deterioration of the image quality in the next print job.

While the disclosure has been described in detail with reference to the above embodiments, it would be apparent to those skilled in the art that various changes and modifications may be made thereto.

For example, the invention is not limited to the printer 100 described above, but is applicable to any apparatus having an image forming function in an electrographic method, such as a multifunction peripheral, a scanner and a facsimile.

In the embodiment, the cleaner 56 is a rotational member rotated by the driving force from the motor 66. However, the cleaner 56 is not limited to a rotational member, and may be a non-rotational member, such as a brush.

The printer 100 adopts the method in which the toner image formed on the photosensitive member 51 is transferred directly to the sheet. However, the image forming apparatus may adopt an intermediate transfer method. For example, in the embodiment, the printer 100 may use the conveyance belt 7 as an intermediate transfer belt. In this case, the toner image formed on the photosensitive member 51 is transferred to the conveyance belt 7, and the toner image on the conveyance belt 7 is further transferred to the sheet by a secondary transfer device (not shown). In such image forming apparatus having the intermediate transfer method, the conveyance belt 7 is an image bearing member, and the secondary transfer device (not shown) is a first collection device, and the belt cleaner 58 is a second collection device. In this case, the specific color, is a color corresponding to a most upstream process device in a toner conveyance direction which is a moving direction of the conveyance belt 7. Here, the most upstream process device firstly transfers the toner image on the conveyance belt 7.

In the embodiment, the current supply devices 64C, 64M, 64Y, and 64K are provided for respective process devices 50C, 50M, 50Y, and 50K. The invention is applicable to a printer having one common power supply device for supplying transferring currents to all of the process devices. Alternatively, a printer may have a plurality of power supply devices and at least one power supply device may supply transferring currents to some of the process devices.

In the embodiment, the common cleaning bias supply device 65 is provided for all the process devices 50. The invention is applicable to a printer having a plurality of cleaning bias supply devices for the process devices 50. The plurality of cleaning bias supply devices may be one-to-one correspondence with the process devices 50.

In the embodiment, the common first charging bias supply device 61 is provided for the three process devices 50, and the second charging bias supply device 62 is provided for the black process device 50K. However, one common charging bias supply device may be provided for all the process devices 50. Note that it is preferable that one charging bias supply device is provided only for the black process device 50K and another charging bias supply device is provided for the process devices 50 other than the black process device 50K for preventing the process devices 50 other than the process device 50K from running out.

In the embodiment, in the printer 100 neither the charging bias nor the weak charging bias is applied to the charging device 52 during the strong scraping period. However, the charging bias or the weak charging bias may be applied to the charging device 52 in order to prevent toner from adhering to the charging device 52. In the printer 100, the transferring current is not supplied to the transferring device 55 in the strong scraping period. However, the transferring current may be supplied to the transferring device 55 in the strong scraping period so that the toner on the surface of the photosensitive member 51 is collected by the belt cleaner 58. Note that it is preferable that the transferring current is not supplied in the strong scraping period and the toner, which was on the surface of the photosensitive member 51, is retained by the cleaner 56 in the strong scraping period so as to be used as abrasive.

In the embodiment, a difference in the peripheral speed between the cleaner 56 and the photosensitive member 51 is increased in the strong scraping period. However, the difference in the peripheral speed between the cleaner 56 and the photosensitive member 51 may not be changed. Note that effect of the scraping is increased as the difference in the peripheral speed between the cleaner 56 and the photosensitive member 51 is increased. Additionally, the changed difference in the peripheral speed between the cleaner 56 and the photosensitive member 51 may be maintained in the ejection period and the cleaning period. Alternatively, the changed difference in the peripheral speed between the cleaner 56 and the photosensitive member 51 may be returned to an initial difference in the ejection period and the cleaning period. The difference in the peripheral speed between the cleaner 56 and the photosensitive member 51 may be increased by increasing the rotational speed of the cleaner 56 or decreasing the rotational speed of the photosensitive member 51. Or, both of the rotational speed of the cleaner 56 and the rotational speed of the photosensitive member 51 may be changed.

In the embodiment, the developing device 54 is separated from the photosensitive member 51 in the strong scraping period. However, the developing device 54 may not be separated from the photosensitive member 51 in the strong scraping period. Note that separation of the developing device 54 from the photosensitive member 51 in the strong scraping period prevents the toner from being supplied, thereby reducing further consumption of the toner caused when scraping the surface of the photosensitive member 51. Supply of the toner in the strong scraping period may be controlled by prohibiting application of a developing bias to the developing roller 541 in addition to or instead of separating of the developing device 54 from the photosensitive member 51.

The strong scraping period is provided, in a case where the accumulation value of the white area of the specific color is larger than the first threshold value Th1, that is, in a case where the condition that the many foreign materials are adhered to the photosensitive member 51 is satisfied. However, the strong scraping period may be performed every time the print job is complete. Note that determination of whether the strong scraping period is provided according to the amount of the foreign materials adhered to the photosensitive member 51 can prevent start of the next printing from being delayed and life of the photosensitive member 51 from being shortened while reducing deterioration of the image quality.

In the embodiment, the amount of the foreign materials on the surface of the photosensitive member 51 is estimated by using the accumulation value of the white areas. However, the amount of the foreign materials may be estimated by other methods. For example, it is estimated that larger the number of printed sheets is, the larger the amount of the foreign materials is. Thus, the amount of the foreign materials is estimated by using the number of printed sheet. Note that the degree of the amount of the foreign materials adhered to the photosensitive member 51 depends on whether areas of the photosensitive member 51 correspond to the white area or not. It is likely that the method for estimating the amount of the foreign materials by using the accumulation value of the white areas as described in the embodiment can obtain the amount of the foreign materials more accurately.

In the embodiment, the accumulation value of the white areas, that is, the amount of the foreign materials is larger than the second threshold value Th2, the strong scraping period is extended. However, the strong scraping period may not be extended and be a fixed period. In the embodiment, when the strong scraping period is extended, the extension period is varied according to the amount of the foreign materials. However, the extension period may be a fixed period. That is, the extension period may have a fixed length.

In the embodiment, the white area, that is, the amount of the foreign materials adhered to the surface of photosensitive member 51, is corrected according to each condition (sheet size, execution or non-execution of duplex print, the charging bias, and the transferring current), and frequency to provide the strong scraping period is adjusted. Instead of or together with these corrections, the first threshold value for determining whether the printer 100 shifts to the scraping period, and the second threshold value for determining whether the scraping period is extended may be corrected.

For example, in the embodiment the white area is increased in the correction process in order to prompt occurrence of the scraping period. Instead of this, the threshold values Th1 and Th2 may be decreased in the correction process. On the other hand, in the embodiment, the white area is decreased in the correction process in order to reduce occurrence of the scraping period. Instead of this, the threshold values Th1 and Th2 may be increased in the correction process.

In the white area calculation process of the embodiment, the CPU 31 makes determinations concerning the small size sheet, the second surface in the duplex printing, the charging bias, the transferring current, and switching on or off the discharge lamp 57 for correcting the white area of the current page. However, all of the determinations may not be necessarily performed, only one of the determinations may be performed, or some determinations may be performed. Further, the white area of the current page may not be corrected. In this case, the white area of the current page acquired in S103 may be added to the accumulation value.

In the embodiment, when the CPU 31 calculates the accumulative value of the white areas, that is, the amount of the foreign materials adhered to the photosensitive member 51 in the process device 50 of color other than yellow. However, the CPU 31 may calculate the amount of the foreign materials adhered to the photosensitive member 51 in the process device 50 of yellow. In other words, any color may be used for calculating the amount of the foreign materials adhered to the photosensitive member 51 in the process device 50.

In the embodiment, the CPU 31 calculates the accumulative value of the white areas, that is, the amount of the foreign materials adhered to the photosensitive member 51 only for the process device 50 which firstly performs the transferring process. However, the amount of the foreign materials (or a white area) may be calculated for each of the process devices 50 and sum all of the calculated amounts of the foreign materials (or the calculated white areas). The sum of all of the calculated amounts of the foreign materials (the calculated white areas) is used as a current mount (or a current white area) of the current page. Note that when the amount of the foreign materials is calculated only for one process device 50, the degree of deterioration of the image quality can be easily estimated.

In the strong scraping period, each photosensitive member 51 is scraped. However, all of the photosensitive members 51 may not necessarily scraped. For example, one of the photosensitive member 51 such as the photosensitive member 51K may be scraped in the strong scraping period. For example, when the printer 100 performs the monochromatic print, toner image may be formed only in the photosensitive member 51K. In this case, only the photosensitive member 51K is scraped in the strong scraping period. In this case, operations in the ejection period and the cleaning period may be performed only for the photosensitive member 51K.

Any process or step in the embodiment may be performed by a single CPU, a plurality of CPUs, hardware such as an ASIC, or any combination of these. The processes or steps in the embodiments may be achieved by the computer-readable storage medium storing the programs, a method, or other manners.

What is claimed is:

1. An image forming apparatus comprising:

an image bearing member having a surface and configured to rotate about an axis;

a collection device in contact with the surface, and configured to collect materials adhered to the surface;

a developing roller configured to provide a charged toner having a first polarity; and a processor configured to perform:

executing a print job in a printing period;

executing, in a non-printing period, a first process in which the image bearing member is rotated at least one rotation while a holding bias is applied to the collection device, the holding bias having a second polarity opposite to the first polarity; and executing, in a non-printing period after the first process, a second process in which the image bearing member is rotated while an ejection bias is applied to the collection device, the ejection bias having the first polarity.

2. The image forming apparatus according to claim 1, wherein the processor is further configured to perform:

estimating an amount of the materials, the amount being an amount of materials which is, at a timing when execution of the print job is complete, adhered to the surface; and determining whether the amount is larger than a first threshold value, wherein the first process is executed when the amount is larger than the first threshold value.

3. The image forming apparatus according to claim 2, wherein the processor is further configured to perform:

determining whether the amount is larger than a second threshold value which is larger than the first threshold value; and set a period of time for completing the execution of the first process so that the period of time, which is set when the amount is larger than the second threshold value, is longer than the period of time which is set when the amount is not larger than the second threshold value.

4. The image forming apparatus according to claim 2, wherein the print job includes an instruction to perform image formation on at least one sheet, wherein the estimating includes calculating, as the amount, an accumulation value of each white area in the at least one sheet, the white area being in contact with the image bearing member in the printing period.

5. The image forming apparatus according to claim 2, wherein the processor is further configured to perform multiplying the amount by a correction coefficient so that the multiplied amount, which is calculated when a sheet used in execution of the print job is smaller than a prescribed size, is larger than the multiplied amount which is calculated when the sheet is not smaller than the prescribed size.

6. The image forming apparatus according to claim 2, wherein the processor is further configured to perform decreasing the first threshold value when a sheet used in the printing period is smaller than a prescribed size.

7. The image forming apparatus according to claim 2, wherein the print job includes an instruction for performing duplex print to print images on a first surface and a second surface of a sheet in this order, wherein the processor is further configured to perform multiplying the amount by a correction coefficient so that the multiplied amount, which is calculated when the second surface in the duplex print is printed, is smaller than the multiplied amount which is calculated when the first surface in the duplex print is printed.

8. The image forming apparatus according to claim 2, wherein the print job includes an instruction for performing duplex print to print images on a first surface and a second surface of a sheet in this order, wherein the processor is further configured to perform increasing the first threshold value when the second surface in the duplex print is printed.

9. The image forming apparatus according to claim 2, further comprising a charger configured to be applied by a charging bias and charge the surface of the image bearing member, wherein the processor is further configured to perform multiplying the amount by a correction coefficient so that the multiplied amount, which is calculated when an absolute value of the charging bias is smaller than a prescribed value in the printing period, is smaller than the multiplied amount which is calculated when the absolute value of the charging bias is not smaller than the prescribed value in the printing period.

10. The image forming apparatus according to claim 2, further comprising a charger configured to be applied by a charging bias and charge the surface of the image bearing member, wherein the processor is further configured to perform increasing the first threshold value when an absolute value of the charging bias is smaller than a prescribed value in the printing period.

11. The image forming apparatus according to claim 2, further comprising a transferring device configured to transfer a toner image formed on the surface of the image bearing member onto a sheet while a transferring current is applied to the transferring device, wherein the processor is further configured to perform multiplying the amount by a correction coefficient so that the multiplied amount, which is calculated when an absolute value of the transferring current is larger than a prescribed value in the printing period, is larger than the multiplied amount which is calculated when the absolute value of the charging bias is not larger than the prescribed value in the printing period.

12. The image forming apparatus according to claim 2, further comprising a transferring device configured to transfer a toner image formed on the surface of the image bearing member onto a sheet while a transferring current is applied to the transferring device, wherein the processor is further configured to perform decreasing the first threshold value when an absolute value of the transferring current is larger than a prescribed value in the printing period.

13. The image forming apparatus according to claim 2, further comprising a discharge device, wherein the image bearing member includes a photosensitive member, wherein the discharge device is configured to discharge a surface of the photosensitive member, wherein the processor is further configured to perform multiplying the amount by a correction coefficient so that the multiplied amount, which is calculated when the discharge device discharges the surface of the photosensitive member in the printing period, is larger than the multiplied amount which is calculated when the discharge device does not discharge the surface of the photosensitive member in the printing period.

14. The image forming apparatus according to claim 2, further comprising a discharge device, wherein the image bearing member includes a photosensitive member, wherein the discharge device is configured to discharge a surface of the photosensitive member, wherein the processor is further configured to perform decreasing the first threshold value when the discharge device discharges the surface of the photosensitive member in the printing period.

15. The image forming apparatus according to claim 2, further comprising a conveyance belt configured to convey a sheet, wherein the image bearing member includes a plurality of photosensitive members, wherein the collection device includes a plurality of cleaners for collecting materials adhered to respective ones of surfaces of the plurality of photosensitive members, wherein the plurality of photosensitive members is in contact with the conveyance belt at respective transferring positions so that a toner image on a surface of each photosensitive member is transferred to the sheet, the transferring positions includes a first transferring position at which the toner image is firstly transferred to the sheet, wherein the amount is calculated for the photosensitive member in contact with the conveyance belt at the first transferring position, wherein when the amount is larger than the first threshold value, the first process is performed for all of the photosensitive members, wherein the second process is performed after the first process is complete for all of the photosensitive members.

16. The image forming apparatus according to claim 2, further comprising a conveyance belt configured to convey a sheet, wherein the image bearing member includes a plurality of photosensitive members, wherein the collection device includes a plurality of cleaners for collecting materials adhered to respective ones of surfaces of the plurality of photosensitive members, wherein the plurality of photosensitive members is in contact with the conveyance belt at respective transferring positions so that a toner image on a surface of each photosensitive member is transferred to the sheet, the transferring positions include a first transferring position and a second transferring position, at the first transferring position a toner image of yellow is firstly transferred to the sheet among the transferring positions, at the second transferring position the toner image which is made color other than yellow is secondly transferred to the sheet among the transferring positions, wherein the amount is calculated for the photosensitive member in contact with the conveyance belt at the second transferring position, wherein when the amount is larger than the first threshold value, the first process is performed for all of the photosensitive members, wherein the second process is performed after the first process is complete for all of the photosensitive members.

17. The image forming apparatus according to claim 1, wherein the processor is further configured to adjust a difference in peripheral speed between the collection device and the image bearing member during the first process so as to be larger than the difference during execution of the print job.

18. The image forming apparatus according to claim 1, wherein the processor is further configured to stopping supply of toner to the surface in the non-printing period before the first process.

19. The image forming apparatus according to claim 1, further comprising a transferring device configured to transfer the charged toner adhered to the surface of the image bearing member onto a sheet while a transferring current is applied to the transferring device, the transferring current having the second polarity, wherein, in the non-printing period after the first process, the processor is configured to perform executing the collection process in which the image bearing member is rotated while the ejection bias is applied to the collection device and a collecting current being applied to the transferring device, the collecting current having the second polarity.

20. A method for controlling an image forming apparatus including: an image bearing member having a surface and configured to rotate; a collection device in contact with the surface, and configured to collect materials adhered to the surface; and a developing roller configured to provide a charged toner having a first polarity, the method comprising:

executing a print job in a printing period;

executing, in a non-printing period, a first process in which the image bearing member is rotated at least one rotation while a holding bias is applied to the collection device, the holding bias having a second polarity opposite to the first polarity; and executing, in the non-printing period after the first process, a second process in which the image bearing member is rotated while an ejection bias is applied to the collection device, the ejection bias having the first polarity.

21. A non-transitory computer readable storage medium storing a set of program instructions installed on and executed by a computer for controlling an image forming apparatus including: an image bearing member having a surface and configured to rotate; a collection device in contact with the surface, and configured to collect materials adhered to the surface; a developing roller configured to provide a charged toner having a first polarity, the set of program instructions comprising:

executing a print job in a printing period;

executing, in a non-printing period, a first process in which the image bearing member is rotated at least one rotation while a holding bias is applied to the collection device, the holding bias having a second polarity opposite to the first polarity; and executing, in the non-printing period after the first process, a second process in which the image bearing member is rotated while an ejection bias is applied to the collection device, the ejection bias having the first polarity.

* * * * *